US008857671B2

(12) United States Patent
Muller et al.

(10) Patent No.: US 8,857,671 B2
(45) Date of Patent: Oct. 14, 2014

(54) DEVICE FOR DISTRIBUTING A FLUID PRODUCT

(75) Inventors: Patrick Muller, Saint Aubin sur Gaillon (FR); Bruno Stuart, Hauville (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/321,080

(22) PCT Filed: Sep. 24, 2010

(86) PCT No.: PCT/FR2010/052007

§ 371 (c)(1),
(2), (4) Date: Nov. 17, 2011

(87) PCT Pub. No.: WO2011/036417

PCT Pub. Date: Mar. 31, 2011

(65) Prior Publication Data

US 2012/0061423 A1 Mar. 15, 2012

(30) Foreign Application Priority Data

Sep. 28, 2009 (FR) ..... 09 56704

(51) Int. Cl.
*B65D 88/54* (2006.01)
*B05B 11/00* (2006.01)

(52) U.S. Cl.
CPC ..... *B05B 11/3052* (2013.01); *B05B 11/3047* (2013.01); *B05B 11/3001* (2013.01); *B05B 11/3059* (2013.01)
USPC ..... 222/321.9; 222/402.1

(58) Field of Classification Search
CPC ..... B05B 11/3052; B05B 11/3001; B05B 11/3059
USPC ..... 222/153.13, 321.1, 321.7, 321.9, 385, 222/402.1; 239/333
See application file for complete search history.

(56) References Cited

U.S. PATENT DOCUMENTS

| | | | | |
|---|---|---|---|---|
| 3,422,996 | A * | 1/1969 | Lipman | 222/402.11 |
| 4,065,036 | A * | 12/1977 | Kirk, Jr. | 222/153.13 |
| 4,162,746 | A * | 7/1979 | Anderson et al. | 222/153.13 |
| 4,420,096 | A * | 12/1983 | Kirk, Jr. | 222/44 |
| 4,434,915 | A * | 3/1984 | Kirk, Jr. | 222/153.13 |
| 7,014,069 | B2 * | 3/2006 | Crosnier et al. | 222/321.9 |
| 7,104,427 | B2 * | 9/2006 | Pericard et al. | 222/402.13 |
| 7,775,402 | B2 * | 8/2010 | Yoshida et al. | 222/153.13 |
| 7,997,451 | B2 * | 8/2011 | Carnacina | 222/153.11 |
| 8,127,968 | B2 * | 3/2012 | Yerby et al. | 222/153.11 |

FOREIGN PATENT DOCUMENTS

| | | |
|---|---|---|
| EP | 0 105 202 A1 | 4/1984 |
| FR | 2 907 768 A1 | 5/2008 |

* cited by examiner

*Primary Examiner* — Daniel R Shearer
(74) *Attorney, Agent, or Firm* — Sughrue Mion, PLLC

(57) ABSTRACT

A fluid dispenser device for mounting on a reservoir. The device has a dispenser member with a body and an actuator rod that is axially movable down and up with the body; a fastener ring for fastening the body on an opening of a reservoir; and a dispenser head mounted on the actuator rod. The dispenser head includes a connection sleeve engaged axially on the actuator rod, the head including a radial duct, an orifice formed in an outer casing that surrounds the connection sleeve, defining a substantially annular gap. The fastener ring includes an axial guide for preventing the dispenser head from turning freely, while enabling it to move axially. The dispenser head includes a guide element that co-operates with the guide, the guide element extending radially from the connection sleeve to the outer casing, in the annular the gap.

11 Claims, 3 Drawing Sheets

DEVICE FOR DISTRIBUTING A FLUID PRODUCT

CROSS REFERENCE TO RELATED APPLICATIONS

This application is a National Stage of International Application No. PCT/FR2010/052007, filed on Sep. 24, 2010, which claims priority from French Patent Application No. 0956704, filed on Sep. 28, 2009, the contents of all of which are incorporated herein by reference in their entirety.

The present invention relates to a fluid dispenser device for associating with a fluid reservoir so as to constitute a fluid dispenser. In addition, the present invention also relates to the dispenser, itself comprising the dispenser device of the invention and a fluid reservoir. Such a dispenser device and such a dispenser are frequently used in the fields of perfumery, cosmetics, or even pharmacy.

Generally, the fluid dispenser device includes a dispenser member that may be a pump or a valve. Nevertheless, other types of dispenser member are not excluded. However, for a pump or a valve, the dispenser member generally comprises a body and an actuator rod that is axially movable down and up within the body under the action of a return spring. In order to fasten the dispenser member on the neck of a reservoir, a fastener ring is conventionally provided. The dispenser device also includes a dispenser head (or pusher) that is mounted on the actuator rod, the head advantageously being provided with a dispenser orifice. This is an entirely conventional design for a dispenser device having a pump or a valve and for use in the fields of perfumery, cosmetics, and pharmacy.

In order to dispense fluid, it suffices to press on the head using one or a more fingers so as to move the actuator rod inside the body. In response, an optionally-measured quantity of fluid is dispensed through the dispenser orifice. Given that the head is mounted on the actuator rod, it is free to turn about its own axis on the actuator rod. As a result, the dispenser orifice can be positioned at any angle relative to the body, and consequently relative to the reservoir. However, it is sometimes useful, or even necessary, to orientate the dispenser orifice correctly relative to the reservoir. This applies in particular when the cross-section of the reservoir presents a configuration that is not circular. For example, the reservoir body may present a configuration that is flat in one direction. In this situation, the user always takes hold of the reservoir in the same way, and it is thus more convenient for the dispenser orifice to be oriented appropriately so as to ensure that dispensing is always well oriented.

Another problem with that type of dispenser device is that, on each actuation, the dispenser head turns through a few degrees together with the actuator rod, under the action of the return spring that gives rise to a small amount of torque. After several actuations, it is possible to see the change in angular position of the dispenser head, which may be troublesome, or even unacceptable, in some situations.

An object of the present invention is to remedy the above-mentioned drawbacks of the prior art by defining a dispenser device having an angular position for the dispenser orifice relative to the body and relative to the reservoir that is unchanging and determined.

To achieve this object, the present invention proposes a fluid dispenser device for mounting on a reservoir so as to constitute a fluid dispenser, the device comprising: a dispenser member comprising a body and an actuator rod that is axially movable down and up within the body; a fastener ring for fastening the body of the dispenser member on an opening of a reservoir; and a dispenser head that is mounted on the actuator rod of the dispenser member, the head being axially movable down and up with the rod, the dispenser head including a connection sleeve that is engaged axially on the actuator rod, the head further including a side dispenser orifice that is connected to the connection sleeve via a radial duct, the orifice being formed in an outer casing that surrounds the connection sleeve in substantially coaxial manner, defining between them a substantially annular gap; the dispenser device being characterized in that: the fastener ring includes axial guide means for preventing the dispenser head from turning freely relative to the dispenser member, while enabling it to move axially; and the dispenser head includes at least one guide element that co-operates with the guide means, the guide element being formed between the connection sleeve and the outer casing, in the annular the gap. More precisely, the guide element may extend radially from the connection sleeve to the outer casing, in the annular gap. Thus, the angular orientation of the dispenser orifice is set relative to the body, and it suffices to orientate the fastener ring properly relative to the reservoir in order to determine the angular orientation of the dispenser orifice relative to the reservoir. It should be observed that axial guidance or prevention from turning takes place entirely inside the dispenser head. The guide means may be incorporated in the ring and the guide element may be incorporated in the dispenser head. In this configuration, axial guidance is provided solely and entirely by co-operation between the fastener ring and the dispenser head, without any need for an additional part.

In another aspect of the invention, the guide element is formed, and advantageously constituted, by the radial duct. Thus, it is not even necessary to add a piece or a part to the dispenser head so as to be able to co-operate properly with the guide means, since it is the radial duct of the head that performs this function. A dispenser head that is entirely conventional or standard may thus be used in the present invention, with only the fastener ring presenting a specific design, making it possible to perform the guide means function.

In an advantageous embodiment, the connection sleeve is connected to the outer casing via a bearing plate on which the user may apply pressure so as to move the actuator head axially down and up, the radial duct connecting the outer casing to the connection sleeve, projecting downwards from the bearing plate and into the annular gap. This is an entirely conventional design for a dispenser device or pusher in the fields of perfumery or cosmetics.

In another aspect of the invention, the fastener ring includes a substantially-cylindrical fastener skirt for coming into engagement with the neck of the reservoir, and a reception housing for receiving the body of the dispenser member, the housing being disposed coaxially inside the skirt, the guide means being formed at the housing, projecting upwards into the annular gap of the actuator head. The ring thus includes a portion that is dedicated specifically to providing guidance, which portion is made integrally therewith, in line with the reception housing. Advantageously, the guide means extend inside the outer casing of the actuator head. Advantageously, the guide means include at least one axial slot that opens upwards, the guide element being engaged downwards into the axial slot.

In a practical embodiment, the guide means include at least one axial slot that opens upwards, the radial duct being engaged downwards into the axial slot. Preferably, the radial duct forms two vertical radial flanges that are slidably engaged in the axial slot with a small amount of clearance. It may be considered that the flanges form an integral part of the duct.

In a practical embodiment, the guide means include a substantially-circular cylinder that forms at least one upwardly-open axial slot for slidably receiving the guide element of the actuator head.

In another advantageous aspect, the fastener ring includes indexer means so as to set the orientation of the ring on a neck of the reservoir.

The invention also defines a fluid dispenser comprising a reservoir and a dispenser device as defined above, the reservoir advantageously presenting a cross-section that is not circular. This is an advantageous application in which it is useful, indeed indispensable, for the angular orientation of the dispenser orifice relative to the reservoir to be unchanging.

The invention is described more fully below with reference to the accompanying drawings, which show an embodiment of the invention by way of non-limiting example.

Figure 1:
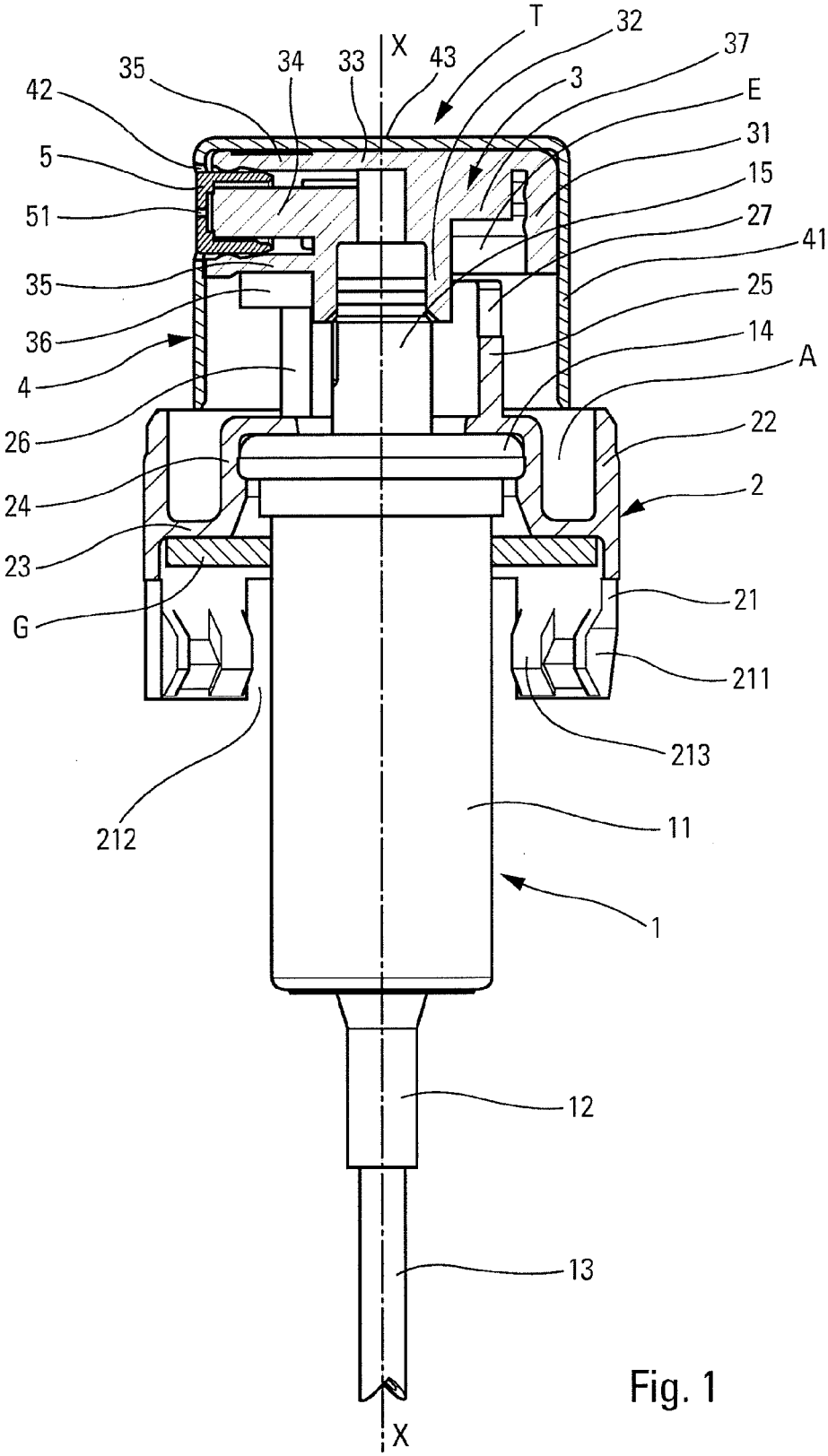
FIG. 1 is an axial vertical section view through a dispenser device of the invention.
Figure 2:
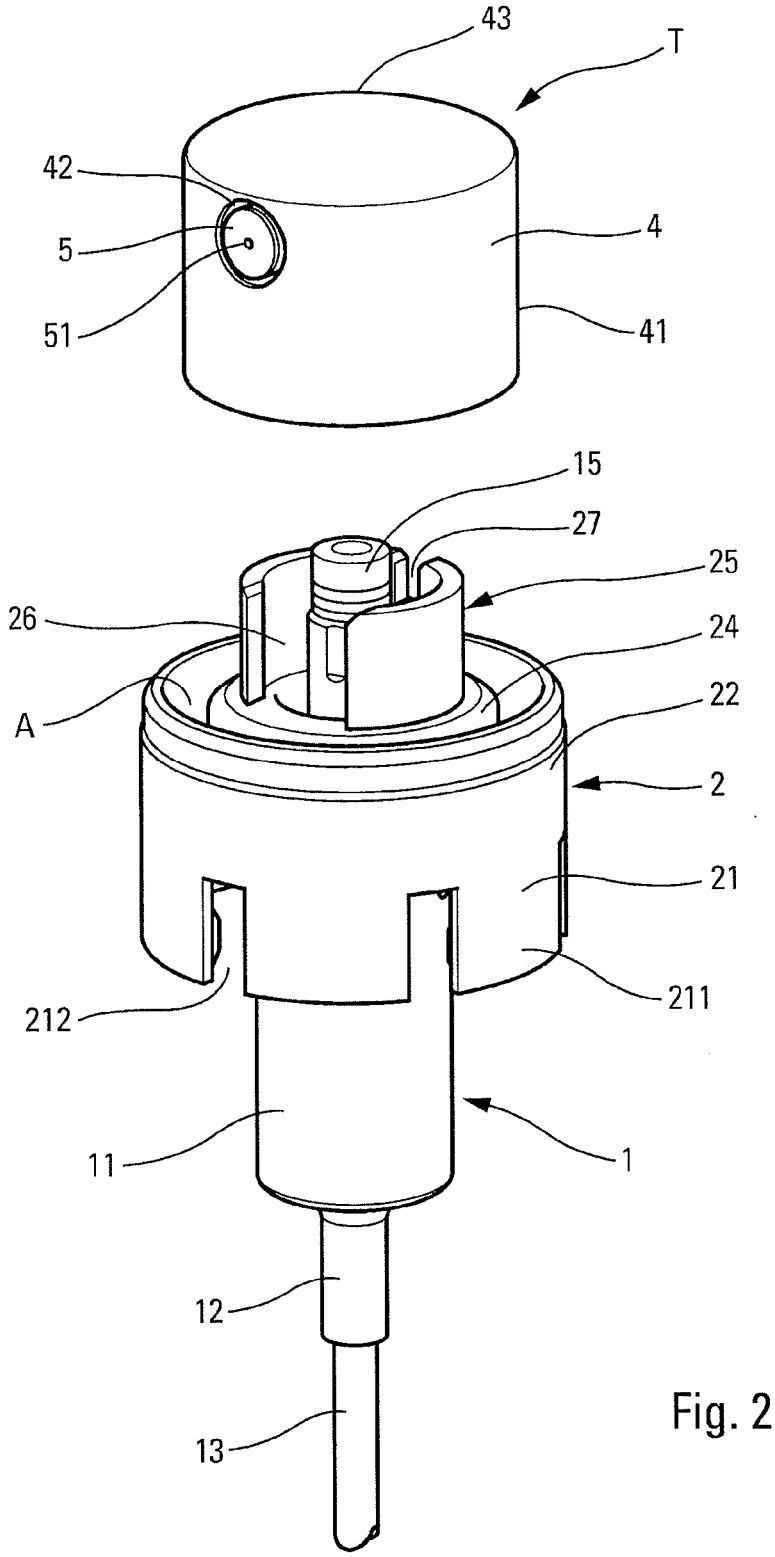
FIG. 2 is an exploded perspective view of the FIG. 1 dispenser device.

Reference is made to all of the figures in order to explain in detail the structure and the operation of the fluid dispenser device in this particular embodiment. The dispenser device comprises three main component elements, namely: a fluid dispenser member 1; a fastener ring 2; and a dispenser head T. Overall, the elements are circularly symmetrical about a vertical axis X. The dispenser device is adapted to be mounted on a reservoir neck so as to constitute a fluid dispenser.

The dispenser member 1 described below incorporates a pump or a valve. Furthermore, in the figures, the internal structure of the dispenser member is not shown, since it does not interfere with the characteristics of the present invention. Regardless of whether it incorporates a pump or a valve, this type of dispenser member comprises a body 11 and an actuator rod 15. More precisely, the body 11 that is preferably made of injection-molded plastics material, comprises a cylinder that is extended at its bottom end by an inlet tube 12, advantageously provided with a dip tube 13. At its top end, the cylinder is terminated by a collar 14 that projects outwards. The actuator rod 15 is engaged inside the body, but a portion of the rod projects axially upwards out from the body. The actuator rod is axially movable down and up inside the body against the action of a spring (not shown). The actuator rod 15 is urged by the spring towards the rest position shown in the figures. The actuator rod 15 internally defines a flow duct for the fluid. The free end of the actuator rod 15 that projects out from the body, is in engagement with the dispenser head T.

In this embodiment, the dispenser head T comprises: a core 3 that is advantageously made of plastics material; an outer cap 4 that is advantageously made of metal; and a nozzle 5 that is made of plastics material.

Figure 3:
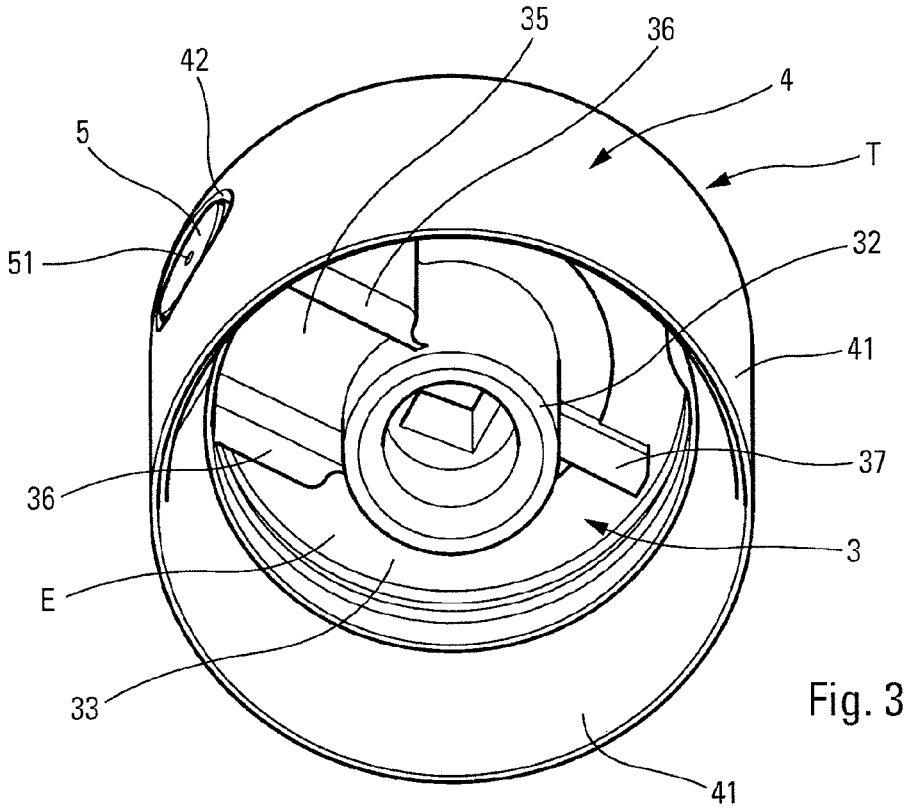
FIG. 3 is a perspective view from below of the core of the dispenser head.

The core 3 includes an outer wall 31 that is substantially cylindrical and that is connected to an axial connection sleeve 32 via a bearing plate 33. The sleeve 32 and the wall 31 are disposed in substantially coaxial manner, so as to define between them a gap E of substantially annular shape. The sleeve 32 is engaged on the free end of the actuator rod 15. Internally, the sleeve forms an internal channel that is connected to a dispenser orifice 51 formed by the nozzle 5 that is fitted on a pin 34 of the core 3. Preferably, the nozzle 5 makes it possible to dispense the fluid in the form of a spray. A radial connection duct 35 is formed around the pin 34: the duct connects the internal channel of the sleeve 32 to the dispenser orifice 51 of the nozzle 5. The duct 35 thus extends radially from the connection sleeve 32 to the outer wall 31, through the gap E. In a particular advantageous embodiment, the radial duct 35 may be provided by two vertical radial flanges 36 that extend on either side of the duct. The flanges perform a function of reinforcing the core and they are incorporated in the duct 35. Each flange 36 connects the outer wall 31 to the sleeve 32, extending downwards from the bearing plate 33, as can be seen clearly in FIG. 3. Optionally, the core may also incorporate a radial bar 37, e.g. that extends in diametrally opposite manner to the duct 35.

In the invention, the radial duct 35, the two radial flanges 36, and the radial bar 37 serve as a guide or turn-preventing element by co-operation with the fastener ring, as described below.

In addition, the cap 4 constitutes an attractive cover that surrounds the core 3, allowing only the nozzle 5 and the bottom of the core to be visible. The cap 4 includes a top bearing wall 43 on which the user may press by means of one or more fingers. The top bearing wall 43 bears directly against the bearing plate 33 of the core, and is extended downwards at its outer periphery by a cover wall 41 of substantially-cylindrical shape in this embodiment. The cover wall 41 extends around the outer wall 31 of the core: the two walls 31 and 41 together constitute an outer casing of the dispenser head T. The cover wall 41 is pierced with a hole 42 through which the nozzle 5 can pass. In the embodiment used to illustrate the invention, the dispenser head is made with an inner core 3 and an outer cap 4. It is also possible to envisage a head that does not have an outer cap, so that it is formed only by a core, e.g. made of plastics material. In this configuration, the outer casing is formed only by the outer wall of the core. The outer casing extends around the connection sleeve 32, defining between them the gap E. The duct 35 is formed between the outer casing and the sleeve, passing radially through the gap E.

In other words, the particular type of dispenser head used in the present invention is not a critical characteristic. It suffices that the head is provided with an axial guide element, such as the radial duct 35 (with or without the two radial flanges 36) and/or the radial bar 37.

As mentioned above, the dispenser device is adapted to be mounted on a reservoir. The reservoir is not shown in the figures, but it may be of a structure that is entirely conventional, and may include a neck that defines a top annular edge that may advantageously be provided with an annular sealing bead. The neck may also form a shoulder that projects outwards. The shoulder serves as a fastener zone for the fastener ring.

In the embodiment used to illustrate the present invention, the body 11 of the dispenser member 1 is held on the neck of the reservoir by means of the fastener ring 2. The ring has the conventional function of holding the dispenser member 1 firmly, and of fastening to the neck of the reservoir containing the fluid to be dispensed. As described below, the fastener ring of the invention performs an additional function, namely a function of providing the dispenser head T with axial guidance or preventing it from turning.

In an entirely conventional manner, the fastener ring 2 is made of injection-molded plastics material, and overall is circularly symmetrical about the axis X. The fastener ring 2 includes a substantially-cylindrical fastener skirt 21 for coming into engagement around the neck of the reservoir. To do this, the skirt 21 may form tabs 211 that are separated by axial notches 212, such that each tab 211 presents a certain amount of elasticity, making it possible to engage the skirt 21 around the neck of the reservoir. In order to fasten the skirt below the shoulder of the reservoir, each tab 211 may be provided with fastener profiles 213 for coming to be housed under the shoulder. This design is entirely conventional for a fastener-ring skirt. In the invention, as visible in FIG. 4, one of the notches 212 presents a particular configuration that serves as indexer means 214, so as to set the orientation of the fastener ring relative to the neck of the reservoir. The indexer means 214 in co-operation with the axial guidance and turn prevention of the dispenser head, make it possible to set the orientation of the dispenser head, as described below.

Figure 4:
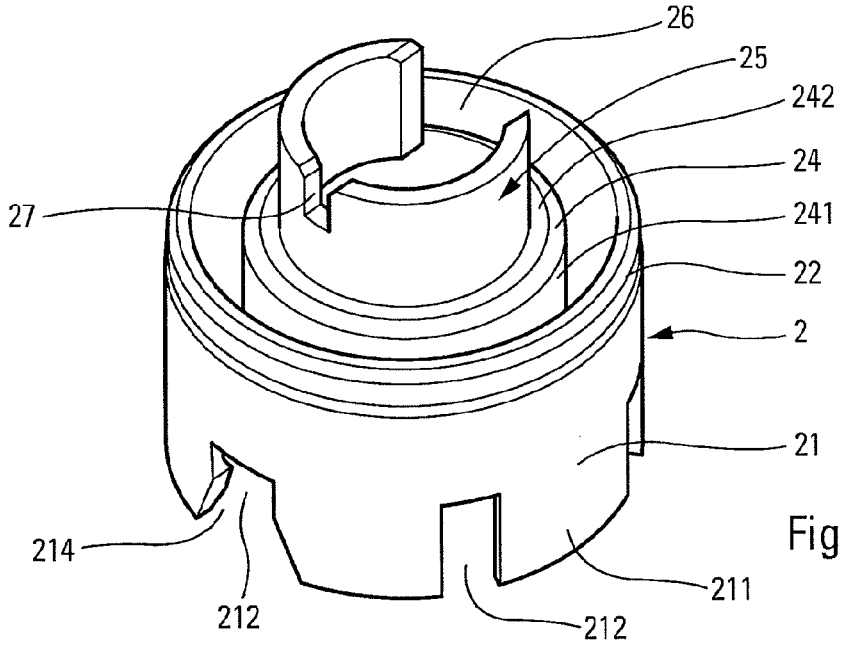
FIG. 4 is a perspective view from above of the core of the fastener ring of the invention.

In addition, the fastener skirt 21 is connected at its top end firstly to an annular flange 23 that extends radially inwards, and secondly to a cylindrical bushing 22 that extends upwards in register with the skirt 21. An O-ring G may be disposed below the annular flange 23 so as to be compressed against the annular edge of the neck of the reservoir. The annular flange 23 extends inwards, forming a reception housing 24 for receiving the collar 14 of the body 11 of the dispenser member 1. By way of example, the collar 14 may be snap-fastened in the housing 24. With reference more particularly to FIG. 4, it can be seen that the housing 24 includes a substantially cylindrical portion 241 that is extended upwards by a substantially annular portion 242 that defines an axial opening through which the actuator rod 15 can pass. In the invention, the reception housing 24 forms, or incorporates, axial guide means 25 that, in this embodiment, are in the form of a cylinder that is provided with two axial notches 26 and 27. The radial notch 27 is optional. The radial notch 26 opens upwards and extends up to the annular portion 242 of the housing 24. The cylinder 25 extends in coaxial manner around the actuator rod 15 relative to the skirt 21 and to the bushing 22. The cylinder 25 even presents a diameter that is smaller than the diameter of the cylindrical portion 241 of the housing 24. In the invention, the axial slot(s) 26 and/or 27 of the cylinder 25 serve as axial guide means in co-operation with the dispenser head T. More precisely, the radial duct 35, possibly provided with its flanges 36, is engaged in the axial slot 26, and may slide therein with little friction. In addition, the radial bar 37 may slide into the slot 27. However, this characteristic is optional. Thus, the cylinder with its slot(s) 26 and/or 27 constitute(s) axial guide means that co-operate with one or more guide elements that are formed by the radial duct 35, the radial flanges 36, and/or the radial bar 37. By way of example, it is possible to make the axial guide means of the fastener ring in the form of a single slot 26 in which there slides the radial duct 35, optionally provided with radial flanges 36. It should be observed that the axial guide means 25 extend inside the dispenser head T, and more precisely inside the outer casing that is constituted by the outer wall 31 and the cover wall 41. As a result, the axial guide means are masked completely, and as a result cannot spoil the overall appearance of the dispenser device. It should even be observed that while the head T is being moved axially down and up, the cover wall 41 penetrates into an annular gap A that is formed between the housing 24 and the bushing 22.

Since the angular orientation of the dispenser head T is thus entirely determined relative to the dispenser member 1, it is possible to determine the angular orientation of the dispenser device relative to the reservoir by means of indexer means 214 that make it possible to orientate the fastener ring 2 on the neck of the reservoir.

An essential advantage of the present invention is that it is possible to use a standard dispenser head, since pre-existing elements, namely the radial duct 35, its radial flanges 36, and/or the radial bar 37, are used as axial guide elements. With regard to the fastener ring, it is modified only very little compared to a conventional fastener ring, since the only added portion is the cylinder 25 with its notches 26 and/or 27. Molding the fastener ring is not more complicated than a standard ring, given the completely axial orientation of the cylinder 25. In a variant, the cylinder 25 may be in the form of a separate part that is fitted on the fastener ring.

With regard to the fastener ring, it may be of a design that is different from the design in the figures: e.g. it is possible to use a fastener ring that is made of metal and that is associated with a part that forms the guide cylinder. It is also possible to envisage a ring that is made of plastics material with a different skirt that incorporates or is provided with a guide cylinder.

Thus, by means of the present invention, it is possible to orientate the dispenser head, while modifying the fastener ring only very little.

The invention claimed is:

1. A fluid dispenser device for mounting on a reservoir so as to constitute a fluid dispenser, the device comprising:

a dispenser member comprising a body and an actuator rod that is axially movable down and up;

a fastener ring for fastening the body of the dispenser member on an opening of a reservoir; and a dispenser head that is mounted on the actuator rod of the dispenser member, the head being axially movable down and up with the rod, the dispenser head including a connection sleeve that is engaged axially on the actuator rod, the head further including a side dispenser orifice that is connected to the connection sleeve via a radial duct, the orifice being formed in an outer casing that surrounds the connection sleeve in substantially coaxial manner, defining between the outer casing and the connection sleeve a substantially annular gap;

wherein:

the fastener ring includes axial guide means for preventing the dispenser head from turning freely relative to the dispenser member, while enabling the dispenser head to move axially; and the dispenser head includes the radial duct that co-operates with the guide means, the radial duct extending radially from the connection sleeve to the outer casing, in the annular the gap, so that a lowest portion of the radial duct joins the connection sleeve to the outer casing;

wherein the guide means include at least one axial slot that opens upwards, the lowest portion of the radial duct being engaged downwards into the axial slot, and wherein an inner channel of the radial duct is axially located at the level of the axial guide means when the dispenser head is in a depressed position.

2. A dispenser device according to claim 1, wherein the connection sleeve is connected to the outer casing via a bearing plate on which the user may apply pressure so as to move the actuator head axially down and up, the radial duct connecting the outer casing to the connection sleeve, projecting downwards from the bearing plate and into the annular gap.

3. A dispenser device according to claim 1, wherein the fastener ring includes a substantially-cylindrical fastener skirt for coming into engagement with the neck of the reservoir, and a reception housing for receiving the body of the dispenser member, the housing being disposed coaxially inside the skirt, the guide means being formed at the housing, projecting upwards into the annular gap of the actuator head.

4. A dispenser device according to claim 1, wherein the guide means extend inside the outer casing of the actuator head.

5. A dispenser device according to claim 1, wherein the radial duct forms two vertical radial flanges that are slidably engaged in the axial slot with a small amount of clearance.

6. A dispenser device according to claim 1, wherein the guide means include a substantially-circular cylinder that forms at least one upwardly-open axial slot for slidably receiving the guide element of the actuator head.

7. A dispenser device according to claim 1, wherein the fastener ring includes indexer means so as to set the orientation of the ring on a neck of the reservoir.

8. A fluid dispenser device comprising a fluid reservoir and a dispenser device according to claim 1.

9. A fluid dispenser device for mounting on a reservoir so as to constitute a fluid dispenser, the device comprising:

a dispenser member comprising a body and an axially movable actuator rod;

a fastener ring that fastens the body of the dispenser member on an opening of a reservoir; and a dispenser head mounted on the actuator rod of the dispenser member, the dispenser head is axially movable with the rod, the dispenser head comprising a connection sleeve engaged with the actuator rod and a side dispenser orifice connected to the connection sleeve via a radial duct;

wherein the orifice is formed in an outer casing that surrounds the connection sleeve so as to define between the outer casing and the connection sleeve a substantially annular gap, and a lowest portion of the radial duct extends from the connection sleeve to the outer casing so as to join the connection sleeve to the outer casing;

the fastener ring comprises an axial guide; and the lowest portion of the radial duct directly engages the axial guide so as to prevent the dispenser head from turning freely relative to the dispenser member, while permitting axial movement of the dispenser head, and wherein an inner channel of the radial duct is axially located at the level of the axial guide means when the dispenser head is in a depressed position.

10. The fluid dispenser device according to claim 9, wherein the axial guide is formed by an axial slot and the radial duct comprises flanges that are slidably engaged in the axial slot.

11. A fluid dispenser device for mounting on a reservoir so as to constitute a fluid dispenser, the device comprising:

a dispenser member comprising a body and an actuator rod that is axially movable down and up;

a fastener ring for fastening the body of the dispenser member on an opening of a reservoir; and a dispenser head that is mounted on the actuator rod of the dispenser member, the head being axially movable down and up with the rod, between a depressed position and a rest position, the dispenser head including a connection sleeve that is engaged axially on the actuator rod, the head further including a side dispenser orifice that is connected to the connection sleeve via a radial duct, the orifice being formed in an outer casing that surrounds the connection sleeve in substantially coaxial manner, defining between the outer casing and the connection sleeve a substantially annular gap;

wherein:

the fastener ring includes axial guide means for preventing the dispenser head from turning freely relative to the dispenser member, while enabling the dispenser head to move axially; and the dispenser head includes at least one guide element that co-operates with the guide means, the guide element extending radially from the connection sleeve to the outer casing, in the annular the gap, so that the guide element joins the connection sleeve to the outer casing, wherein the orifice is located axially at the level of the guide element in the depressed position;

wherein the guide element is the radial duct, and the radial duct is formed around a pin which is axially located at the level of the axial guide means when the dispenser head is in the depressed position.

* * * * *